US005857626A

United States Patent [19]

Hsu

[11] Patent Number: 5,857,626

[45] Date of Patent: Jan. 12, 1999

[54] ATOMIZER PRODUCING A SUPERFINE SPRAY

[76] Inventor: Chih-Lung Hsu, 90-20, Sec. 3, Xi Tun Road, Taichung, Taiwan

[21] Appl. No.: 947,743

[22] Filed: Oct. 9, 1997

[51] Int. Cl.[6] ..... B05B 3/04

[52] U.S. Cl. ..... 239/381

[58] Field of Search ..... 239/380, 381, 239/382

[56] References Cited

U.S. PATENT DOCUMENTS 1,515,664 11/1924 Dunkelberger ..... 239/381
2,737,770 2/1956 Kurata ..... 239/380

FOREIGN PATENT DOCUMENTS 2089684 6/1982 United Kingdom ..... 239/381

*Primary Examiner*—Andres Kashnikow
*Assistant Examiner*—Dinh Q. Nguyen
*Attorney, Agent, or Firm*—Peterson, Wicks, Nemer & Kamrath, P.A.

[57] ABSTRACT

Disclosed is an atomizer producing a superfine spray which is assembled mainly from a base, an interconnection member, and a cock, and is connected to a union connecting two water pipes. The base has filter material disposed therein, the interconnection member has an elastic stopper means disposed therein, and the cock has a spin element disposed therein. A high-pressure water flow is transferred via water pipes and enters the base of the atomizer when it passes the union. The high-pressure water is filtered in the base and pushes away the elastic stopper means to enter into the cock via the interconnection member. High-pressure water entering the cock fiercely flushes and rotates the spin element in the cock. The rotating spin element in turn swirls and splashes the water to produce a superfine spray which is forced into open air via a pin hole on the cock and can be dissolved in the air to effectively lower the ambient temperature.

4 Claims, 3 Drawing Sheets

ATOMIZER PRODUCING A SUPERFINE SPRAY

BACKGROUND OF THE INVENTION

The present invention relates to an atomizer producing a superfine spray.

There are two ways currently adopted to lower the temperature in an animal shed. The first way is to sprinkle water to wet the ground in the shed. And, the second way is to spray water through the air in the shed. In the first way of lowering temperature in the shed by sprinkling water, the water will then directly contact with dropping and sewage on the ground and promotes production and release of hazardous substance and gas when the soiled water being heated under high temperature. This will, of course, have adverse influences on the animals in the shed. On the other hand, the second way of lowering temperature in the shed by spraying water shall moisten and cool the air in the shed with atomized water directly dissolved in the air. However, there are chances that the water is not sufficiently atomized and form oversized drops which fall to reach the ground before they are vaporized in the air, and constantly wet the ground in the shed, causing the same hazards as that caused by the above mentioned first way. That is, both the two currently adopted ways to lower temperature in a shed will produce bad and improper humidity in the shed. Therefore, it is desirable to develop an improved way to achieve the purpose of lowering temperature in an animal shed.

SUMMARY OF THE INVENTION

A primary object of the present invention is to provide an atomizer producing a superfine spray so that a high-pressure water source may be further atomized to a superfine spray. Such superfine spray can dissolve and suspend in the air to lower the temperature in the animal shed.

BRIEF DESCRIPTION OF THE DRAWINGS

The above and other objects as well as the structure of the present invention can be better understood by referring to the following detailed description of the preferred embodiment and the accompanying drawings, wherein.

DETAILED DESCRIPTION OF THE PREFERRED EMBODIMENTS

Figure 1:
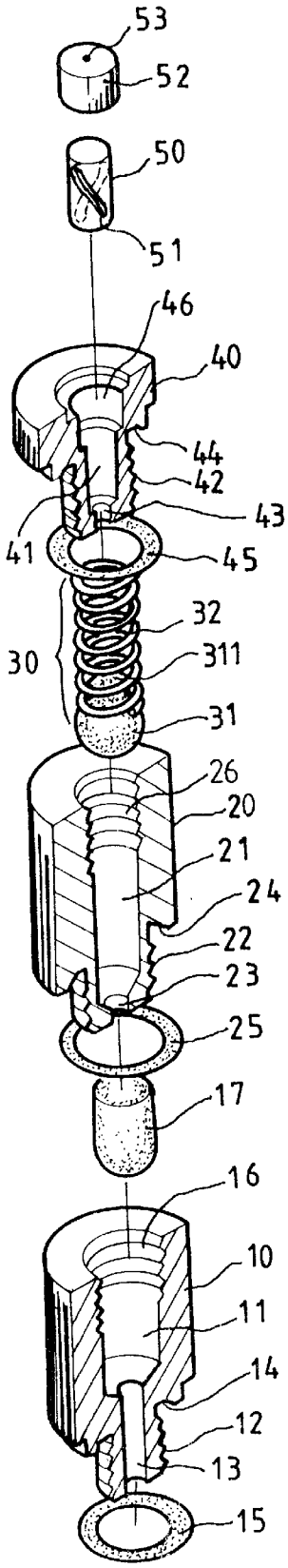
FIG. 1 is an exploded perspective of an atomizer according to the present invention.
Figure 2:
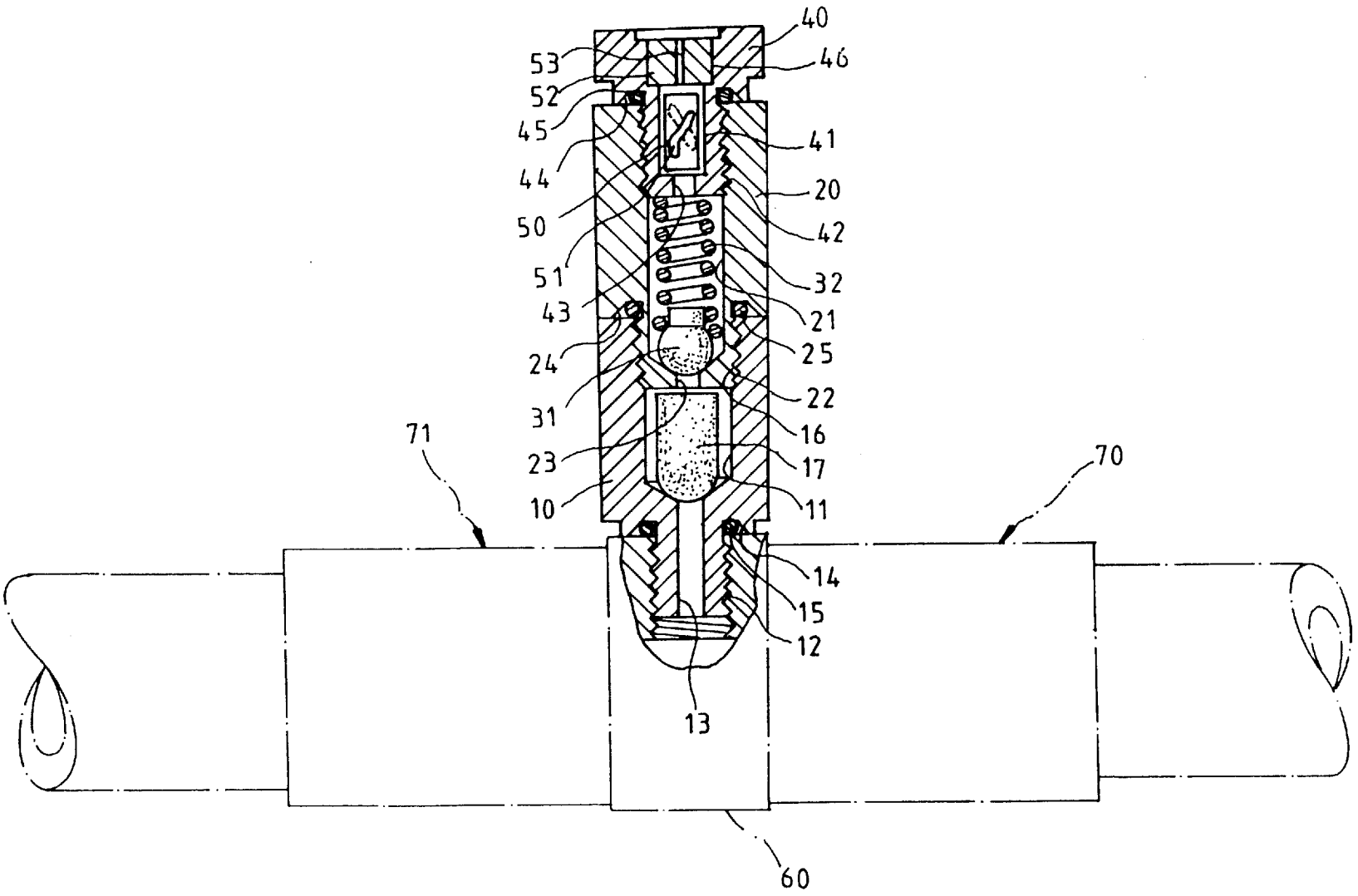
FIG. 2 is a sectional view of the atomizer of FIG. 1 in an assembled state.

Please first refer to FIGS. 1 and 2 which are exploded perspective and assembled sectional views, respectively, of an atomizer according to the present invention. As shown, the atomizer of the present invention mainly includes a base 10, an interconnection member 20 above the base 10, an elastic stopper means 30, and a cock 40.

The base 10 defines a chamber 11 and has an externally threaded bottom extension 12 downward projecting from a bottom of the chamber 11. An axial through hole 13 is formed inside the bottom extension 12 to communicate the chamber 11 with the bottom extension 12. An annular recess 14 is formed around a root of the bottom extension 12 to receive a first O-ring 15 therein. The chamber 11 is provided at a top portion of its inner circumferential wall with an internally threaded portion 16. A filter 17 is disposed inside the chamber 11.

The interconnection member 20 defines a chamber 21 and has an externally threaded bottom extension 22 downward projecting from a bottom of the chamber 21. An axial through hole 23 is formed inside the bottom extension 22 to communicate the chamber 21 with the bottom extension 22. An annular recess 24 is formed around a root of the bottom extension 22 to receive a second O-ring 25 therein. The chamber 21 is provided at a top portion of its inner circumferential wall with an internally threaded portion 26. The elastic stopper means 30 is disposed in the chamber 21. The bottom extension 22 may be fitly screwed into the internally threaded portion 16 of the chamber 11, so that the interconnection member 20 is firmly associated with the base 10.

The elastic stopper means 30 includes a ball stopper 31 and a spring 32. The ball stopper 31 has a ball end being normally pressed by the spring 32 against the through hole 23 of the interconnection member 20 and a locating part 311 opposite to the ball end and inserting into a lower end of the spring 32.

The cock 40 defines a chamber 41 which has an externally threaded area 42 provided around an outer circumferential wall thereof. A through hole 43 is formed at a bottom of the chamber 41. An annular recess 44 is formed around a root of the threaded area 42 to receive a third O-ring 45 therein. A diameter-enlarged upper chamber 46 is also defined by the cock 40 to locate above the chamber 41. A spin element 50 is disposed in the chamber 41. The spin member 50 may be a solid cylindrical body with several curved guiding grooves 51 provided on a circumferentical surface thereof. A sealing block 52 having an axially extended pin hole 53 is fixedly disposed in the upper chamber 46 to lock the spin element 50 in the chamber 41 and press the same against the through hole 43. The cock 40 is screwed into the interconnection member 20 by engaging its threaded area 42 with the internally threaded portion 26 of the chamber 21, so that a complete atomizer producing superfine spray is formed, as shown in FIG. 2. The completed atomizer for producing superfine spray is screwed onto a pipe union 60 which connects two lengths of water pipes 70, 71 together. More than one pipe union 60 can be used to connect more water pipes to form a complete water flow arrangement.

Figure 3:
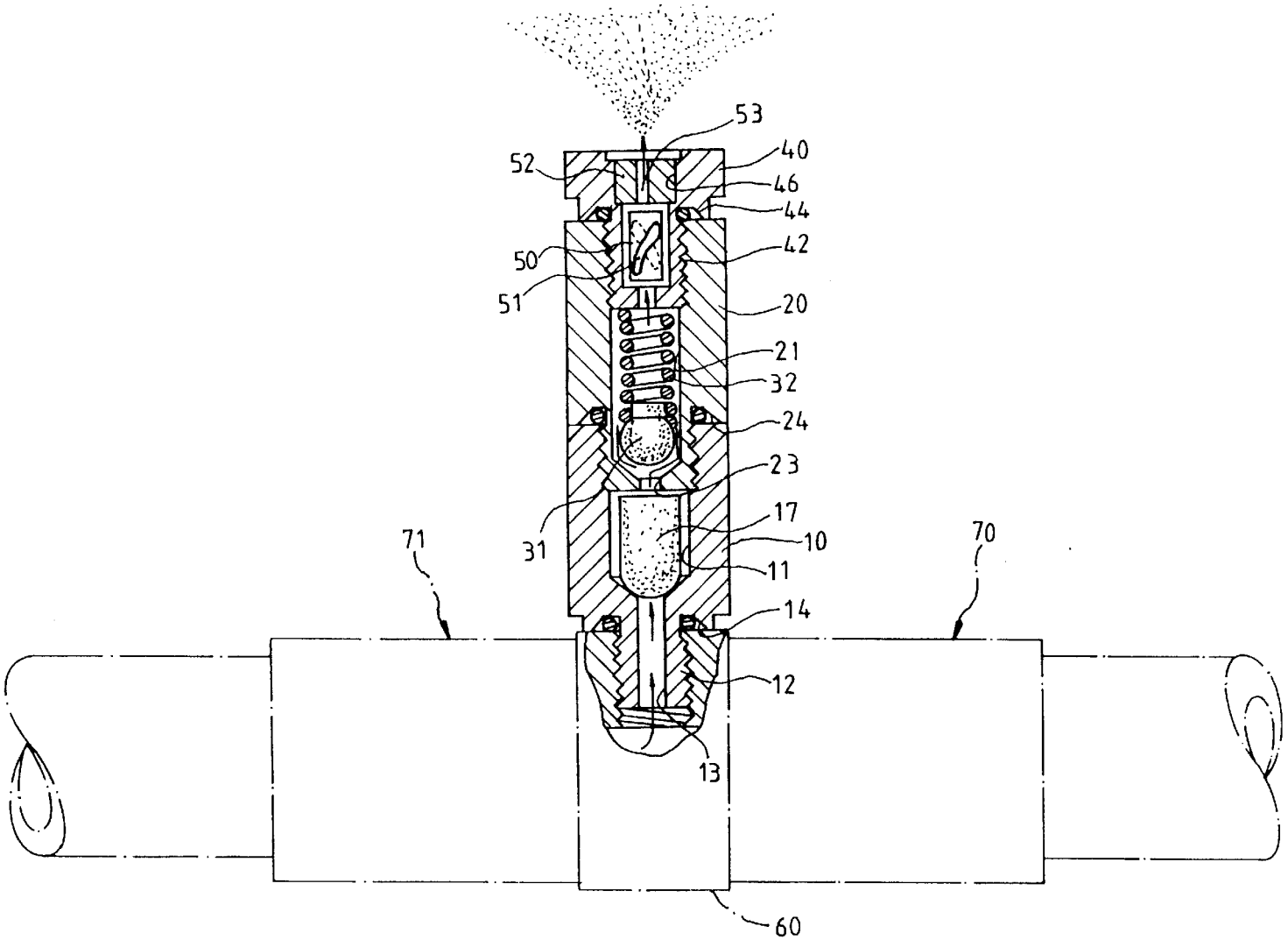
FIG. 3 is a sectional view showing the operation of the atomizer of FIG. 1.

Please now refer to FIG. 3 for the operation of the atomizer of the present invention. Water is pumped from a water source (not shown) to flow through a filter (not shown) to primarily remove impurities from the water. Then, the filtered water is sent to the pipe 70 by means of a highly pressurized feeding machine (not shown), so that the water flows through the union 60 into another pipe 71 connected to the other end of the union 60 and is transferred to another union 60 and other more pipes 70 and 71. When the highly pressurized water passes the union 60, it flows into the atomizer connected to the union 60 via the through hole 13 formed on the base 10 of the atomizer. The water further flows into the chamber 11 and the filter 17 disposed in the chamber 11 for a second time filtration to remove even finer impurities from the water. The water then passes the through hole 23 of the interconnection member 20. At this point, the highly pressurized water exerts an upward pressure on the ball stopper 31, which is originally pressed by the spring 32 against the through hole 23, to open the through hole 23. The water is allowed to enter the chamber 21 now.

The highly-pressurized water now flows into the chamber 41 of the cock 40 via the through hole 43. After entering into the chamber 41, the water fiercely flushes the spin element

50. Due to the curved guiding grooves 51 on the spin element 50, the high-pressure water flow not only flushes the spin element 50 and the curved guiding grooves 51, but also brings the spin element 50 to spin at high speed. The curved guiding grooves 51 on the quickly spinning element 50 in turn swirls and splashes the highly-pressurized water flow and causes the water to atomize. The atomized water then passes the pin hole 53 on the sealing block 52 into the open air. Up to this point, the water has been subjected to a series of atomization processes and is finally atomized to very tiny drops with an average diameter in the range from 1 to 16 $\mu$m (about 0.01 mm). A superfine spray is therefore achieved. Such superfine spray suspends in the atmosphere and is fully absorbed by the hot air, and therefore, lowers the ambient temperature. Moreover, the atomizer of the present invention can be employed in spraying fumigant and other pesticide, drug, cleaner, etc., to achieve better diffusion of these agents in a form of superfine spray.

What is claimed is:

1. An atomizer producing a superfine spray comprising a base, an interconnection member, and a cock;

said interconnection member defining a second chamber and having a second externally threaded extension portion downward projected from a bottom of said second chamber, said second extension portion being provided with an axially extended second through hole to communicate said second chamber with said second extension portion, said second chamber having a second internally threaded upper portion, an elastic stopper means being disposed in said second chamber and having a lower ball end to elastically press against a top end of said second through hole and an upper locating part extending into a spring above said elastic stopper means to normally press said ball end against said second through hole; and said cock defining a third chamber having an externally threaded wall area and a third through hole formed at a bottom thereof and an upper chamber with enlarged diameter located above said third chamber; a spin element being disposed in said third chamber and a sealing block with an axial pin hole being disposed in said upper chamber to lock said spin element in said third chamber; and said cock being firmly connected to a top of said interconnection member by screwing said externally threaded wall area of said third chamber into said second internally threaded upper portion of said second chamber.

2. An atomizer producing a superfine spray as claimed in claim 1, wherein said base defines a first chamber and having a first externally threaded extension portion downward projected from a bottom of said first chamber, said first extension portion being provided with an axially extended first through hole to communicate said first chamber with said first extension portion, said first chamber having a first internally threaded upper portion, a filter material being disposed in said first chamber; and wherein said interconnection member is firmly connected to a top of said base by screwing said second externally threaded extension portion into said first internally threaded upper portion of said first chamber.

3. An atomizer producing a superfine spray as claimed in claim 1, wherein said spin element is a solid cylindrical body having several curved guiding grooves formed on a circumferential surface of said spin element.

4. An atomizer producing a superfine spray as claimed in claim 1, wherein said base, said interconnection member, and said cock all have an annular recess formed around a root of their respective said first externally threaded extension portion, said second externally threaded extension portion, and said externally threaded wall area for respectively receiving an O-ring therein, in order to prevent leakage at joints between these components.

* * * * *